US010517363B2

(12) United States Patent
Su et al.

(10) Patent No.: US 10,517,363 B2
(45) Date of Patent: Dec. 31, 2019

(54) 2D STYLISH BAG STRUCTURE

(71) Applicant: PINZAAN CO., LTD., Taipei (TW)

(72) Inventors: Siao Cian Su, Taipei (TW); Yu Rou Lin, Taipei (TW)

(73) Assignee: PINZAAN CO., LTD., Taipei (TW)

( * ) Notice: Subject to any disclaimer, the term of this patent is extended or adjusted under 35 U.S.C. 154(b) by 43 days.

(21) Appl. No.: 15/479,841

(22) Filed: Apr. 5, 2017

(65) Prior Publication Data

US 2018/0140067 A1 May 24, 2018

(30) Foreign Application Priority Data

Nov. 24, 2016 (TW) ..... 105217957 U

(51) Int. Cl.

| | |
|---|---|
| ***A45C 13/08*** | (2006.01) |
| ***A45C 3/06*** | (2006.01) |
| ***A45C 3/02*** | (2006.01) |

(52) U.S. Cl.

CPC ..... *A45C 13/08* (2013.01); *A45C 3/02* (2013.01); *A45C 3/06* (2013.01)

(58) Field of Classification Search

CPC .. A45C 3/06; A45C 13/26; A45C 3/00; A45C 13/10; A45C 3/04; A45C 13/08

USPC ..... 150/107, 100; 383/104, 20, 5, 117; D3/234, 238

See application file for complete search history.

(56) References Cited

U.S. PATENT DOCUMENTS 5,009,319 A * 4/1991 Jantzen ..... A45C 3/00 150/104

* cited by examiner

*Primary Examiner* — Sue A Weaver

(74) *Attorney, Agent, or Firm* — Cantor Colburn LLP

(57) ABSTRACT

A bag structure with a first feature surface, a second feature surface, and a back surface is provided. The first feature surface has a first border that defines the virtual first view of the bag structure. The second feature surface has a second border that defines a virtual second view of the bag structure. The back surface is arranged opposite to the first feature surface and the second feature surface. The combination of the first feature surface, second feature surface, and back surface defines the bag structure. The first and second feature surface are substantively on the same visual plane.

9 Claims, 9 Drawing Sheets

2D STYLISH BAG STRUCTURE

CROSS REFERENCE TO RELATED APPLICATIONS

The present invention claims priority under 35 U.S.C. § 119 to Taiwan Patent Application No. 105217957, filed Nov. 24, 2016, the entire content of which is incorporated herein by reference.

BACKGROUND OF THE INVENTION

Field of the Invention

The present invention provides a 2D stylish bag structure, and particularly, to a 2D stylish bag structure capable of presenting a perspective 3D visual effect on a single visual plane.

Descriptions of the Related Art

The conventional handbag usually has an overall structure that is bilaterally or longitudinally symmetric. When viewed in the front (i.e., from the front direction of the handbag), the front side of the conventional handbag can only present a single front-plane visual effect that is monotonous. To achieve a perspective visual effect, the viewer must change the position or angle at which he or she views the handbag.

The handbag that is carried on the shoulder, by the hand or on the back seldom changes its position with respect to the user unless the user intentionally takes it off for display, changes the angle thereof or take things out of/put things into the handbag. Therefore, the 3D quality or visual effect of the handbag design cannot be shared with others. This is the case for general handbags that focus only on the brand, material, shape and design variations involving patterns and colors of a single visual front surface without tactically designing the 3D outline of the handbags. Such a conventional handbag design idea provides relatively limited eye-catching effects that stimulate the consumers' desire to buy such handbags.

Accordingly, it is important to provide a stylish bag structure which provides a perspective 3D visual effect of the handbag on a single visual plane to stimulate the consumers' interests in the handbag.

SUMMARY OF THE INVENTION

An objective of the present invention is to provide a 2D stylish bag structure with a special perspective 3D visual effect on a single visual plane to stimulate the consumers' interests on the bag.

Another objective of the present invention is to provide a 2D stylish bag structure with a special perspective 3D visual effect when being hung from a wall so that it appears to look like a picture or a decoration on the wall.

To achieve the aforesaid objective, the 2D stylish bag structure of the present invention comprises a first feature surface, a second feature surface and a back surface. The first feature surface has a first border that defines the virtual first view of the 2D stylish bag structure. The second feature surface has a second border that defines the virtual second view of the 2D stylish bag structure. The back surface is disposed opposite the first feature surface and the second feature surface. Wherein, the combination of the first feature, second feature and back surface is capable of defining the 2D stylish bag structure, and the first and second feature surface are substantively on the same visual plane.

To achieve the aforesaid objective in the 2D stylish bag structure of the present invention, the virtual first view is a virtual front view, while the virtual second view is a virtual side view, a virtual top view, a virtual bottom view or the combination of any two of the above views.

To achieve the aforesaid objective, the 2D stylish bag structure of the present invention optionally comprises at least one flip-cover structure that is disposed on and covers the first feature surface and/or the second feature surface.

To achieve the aforesaid objective, the 2D stylish bag structure of the present invention optionally comprises at least one handle structure that is sewed to connect with the first feature surface and/or the second feature surface and has a third border.

To achieve the aforesaid objective in the 2D stylish bag structure of the present invention, there are at least two or more handle structures, and the position of the handle structure is opposite to and overlaps or slightly offsets each other.

To achieve the aforesaid objective, the handle structure optionally comprised in the 2D stylish bag structure of the present invention is flat.

To achieve the aforesaid objective, in the 2D stylish bag structure of the present invention, the first, second and third border have a width between 1 mm to 20 mm.

To achieve the aforesaid objective, the 2D stylish bag structure of the present invention further comprises at least one storage layer that is disposed between the visual plane and the back surface.

To achieve the aforesaid objective in the 2D stylish bag structure of the present invention, the storage layer has a receiving space and the section of the receiving space is in the form of a triangle, a rectangle, a trapezoid or a round.

To achieve the aforesaid objective, another 2D stylish bag structure of the present invention comprises a first feature surface and at least one flip-cover structure. The first feature surface has a first border that defines the virtual first view of the 2D stylish bag structure. The flip-cover structure is disposed on and covers the first feature surface in a slightly offset manner.

To achieve the aforesaid objective in the 2D stylish bag structure of the present invention, the virtual first view is a virtual front view.

To achieve the aforesaid objective, the 2D stylish bag structure of the present invention optionally comprises at least one tongue flake structure that is sewed to connect with the first feature surface or at least one flip-cover structure.

To achieve the aforesaid objective, the 2D stylish bag structure of the present invention further comprises at least one storage layer that is disposed on the first feature surface at one side covered by the flip-cover structure.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

In the following description, the present invention will be explained with reference to embodiments thereof. It should be appreciated that in the following embodiments and attached drawings, elements not directly related to the present invention are omitted from depiction; and the sizes of and positional relationships among individual elements in the attached drawings are illustrated only for the ease of understanding but not to limit the actual scale and sizes.

Figure 1:
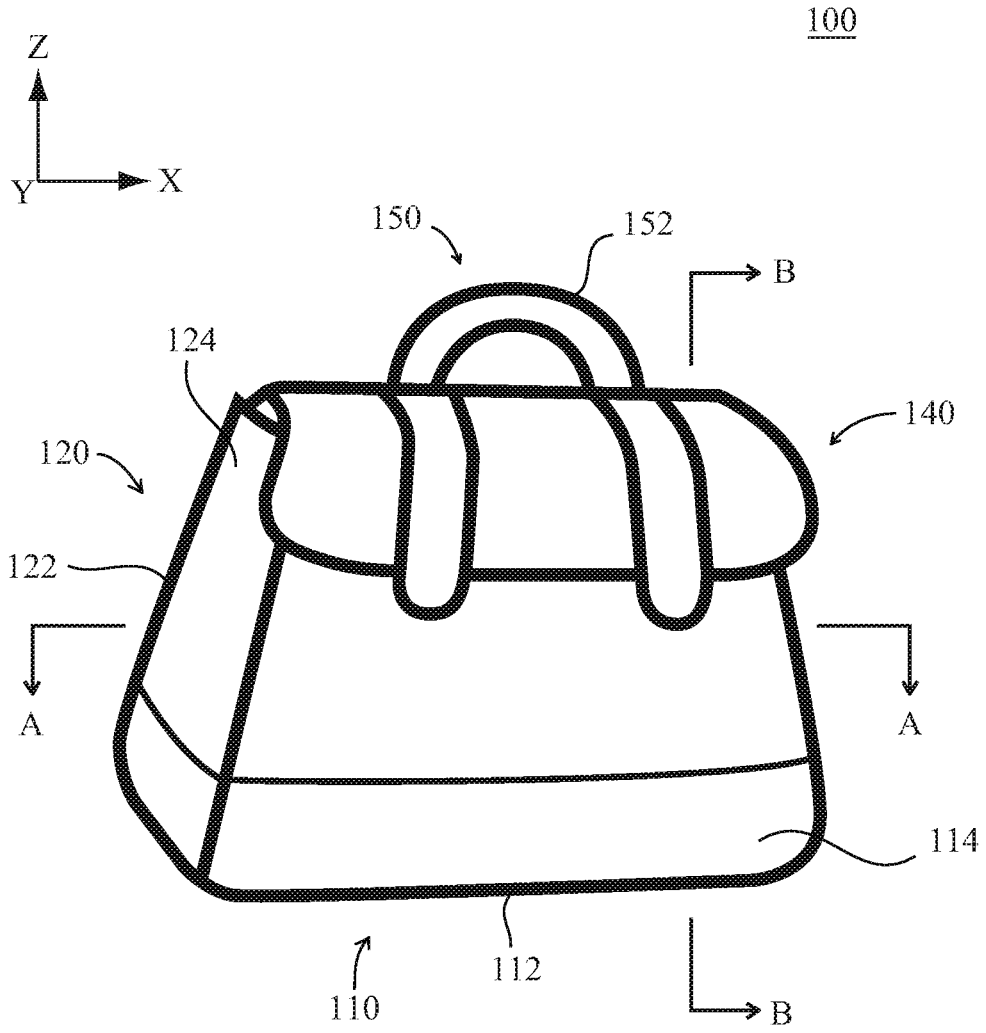
FIG. 1 is a schematic front view of a 2D stylish bag structure according to the present invention.
Figure 3:
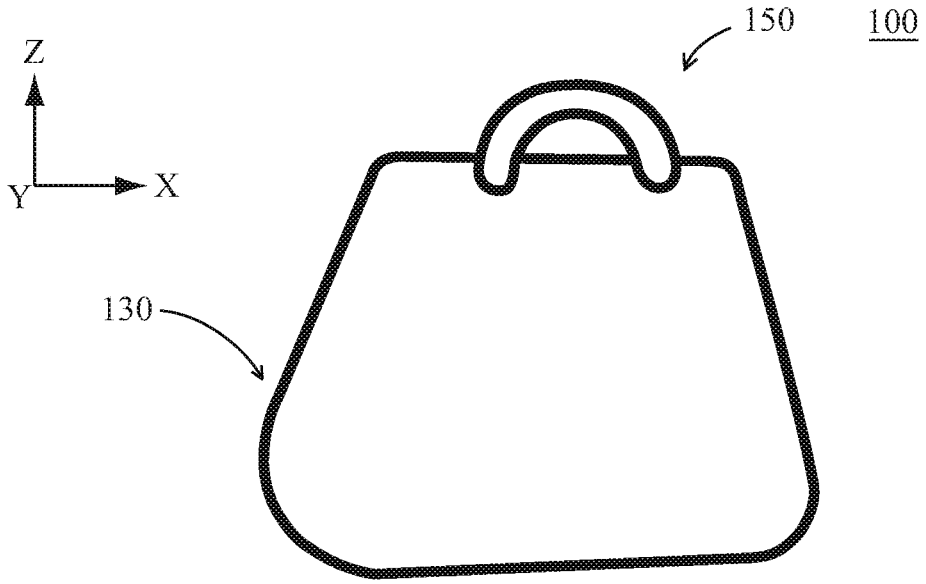
FIG. 3 is a schematic back view of the 2D stylish bag structure according to the present invention.
Figure 6:
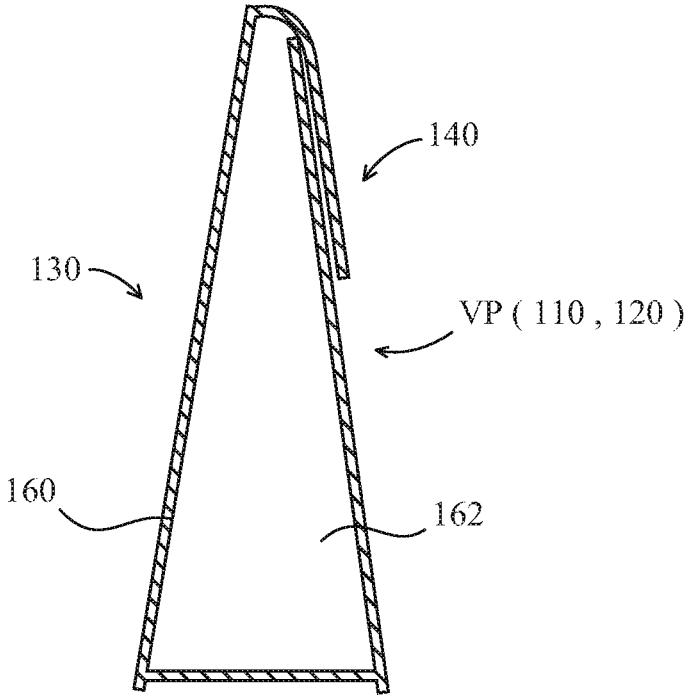
FIG. 6 is a cross-sectional view of the 2D stylish bag structure according to the present invention that is taken along line B-B in FIG. 1.

The first embodiment of the present invention is shown in FIG. 1 and FIG. 3. Specifically, a 2D stylish bag structure 100 comprises a first feature surface 110, a second feature surface 120 and a back surface 130. The first feature surface 110 has a first border 112 that defines the virtual first view 114 of the 2D stylish bag structure 100. The second feature surface 120 has a second border 122 that defines the virtual second view 124 of the 2D stylish bag structure 100. The back surface 130 is disposed opposite the first feature surface 110 and the second feature surface 120. In this embodiment, the virtual first view 114 is a virtual front view of the stylish bag, while the virtual second view 124 is a virtual side view of the stylish bag. Then, as shown in FIG. 6, the combination of the first feature surface 110, the second feature surface 120, and the back surface 130 is capable of defining the 2D stylish bag structure 100. The first feature surface 110 and the second feature surface 120 are substantively on the same visual plane VP.

It shall be appreciated that in addition to being a virtual side view as shown in FIG. 1, the virtual second view 124 of the 2D stylish bag structure 100 may also be a virtual top view, a virtual bottom view, or the combination of any two of the virtual side, top or bottom view. For example, in the 2D bag structure 100 shown in FIG. 8, the virtual second view 124 is a combination of a virtual side and top view.

Figure 2:
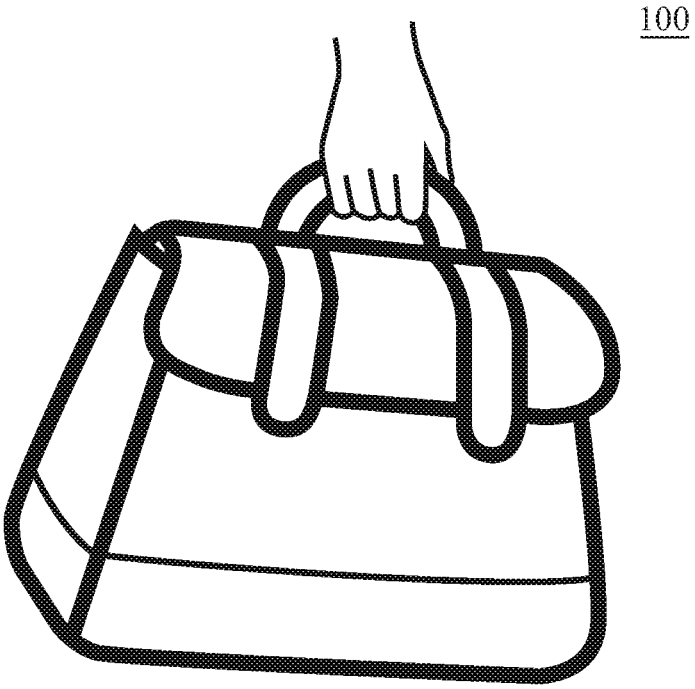
FIG. 2 is a schematic view of the 2D stylish bag structure in usage according to the present invention.

Therefore, when a consumer holding the 2D stylish bag structure 100 of the present invention in hand views the 2D stylish bag structure 100 in the front direction (i.e., in the normal direction of the XZ plane) as shown in FIG. 2, a visual illusion is created due to the picture formed by the virtual first view 114 and the virtual second view 124 of the 2D stylish bag structure 100 to provide a special perspective 3D visual effect.

Figure 4:
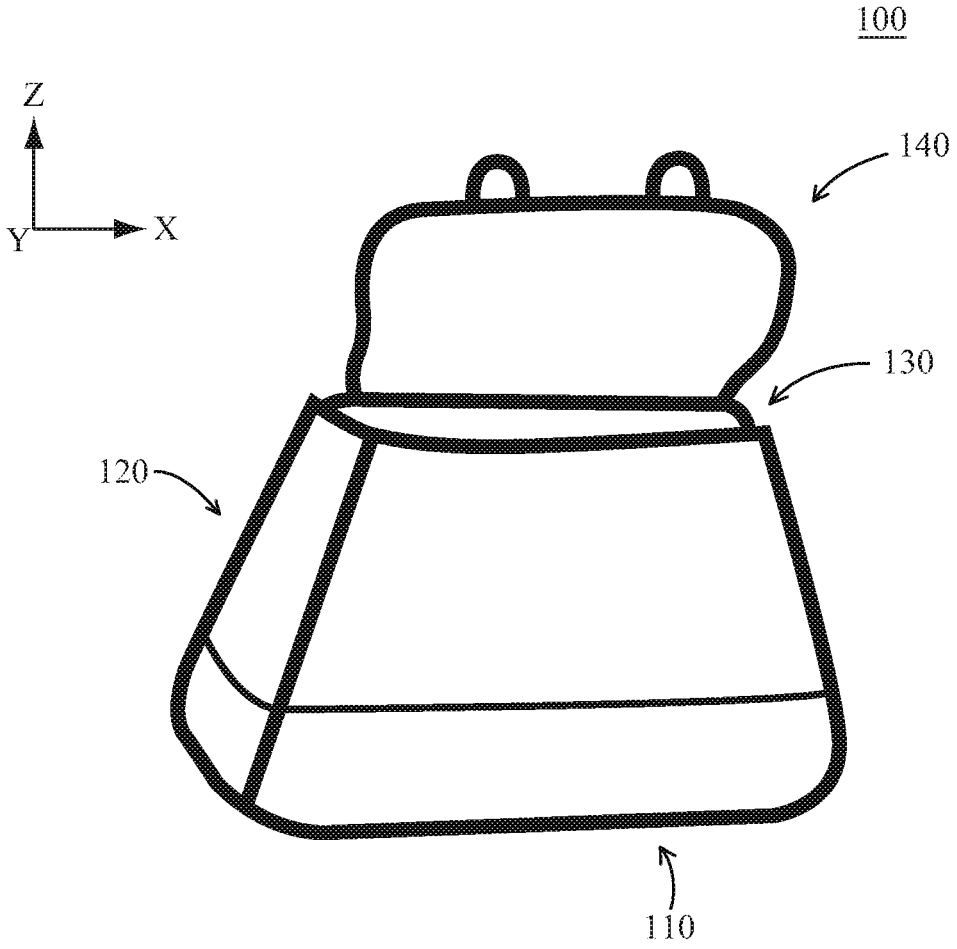
FIG. 4 is a schematic view of the 2D stylish bag structure according to the present invention when the flip-cover structure is in an opened state.

With reference to both FIGS. 1 and 4, the 2D stylish bag structure 100 in the illustrated embodiment of the present invention optionally comprises a flip-cover structure 140 and a handle structure 150. The flip-cover structure 140 is disposed on the back surface 130 and partially or totally covers the first feature surface 110 and/or the second feature surface 120. The handle structure 150 has a third border 152 and is sewed to the back surface 130.

In this way, by disposing the flip-cover structure 140 to partially or totally cover the virtual first view 114 of the first feature surface 110 and/or the virtual second view 124 of the second feature surface 120, the perspective 3D visual illusion can be enhanced when the consumer views the bag. On the other hand, the disposition of the flip-cover structure 140 also helps to prevent drop out of articles that are placed in the 2D stylish bag structure 100. The handle structure 150 is not only decorative, but can also be held by the consumer to increase the stability in using the bag.

Figure 7:
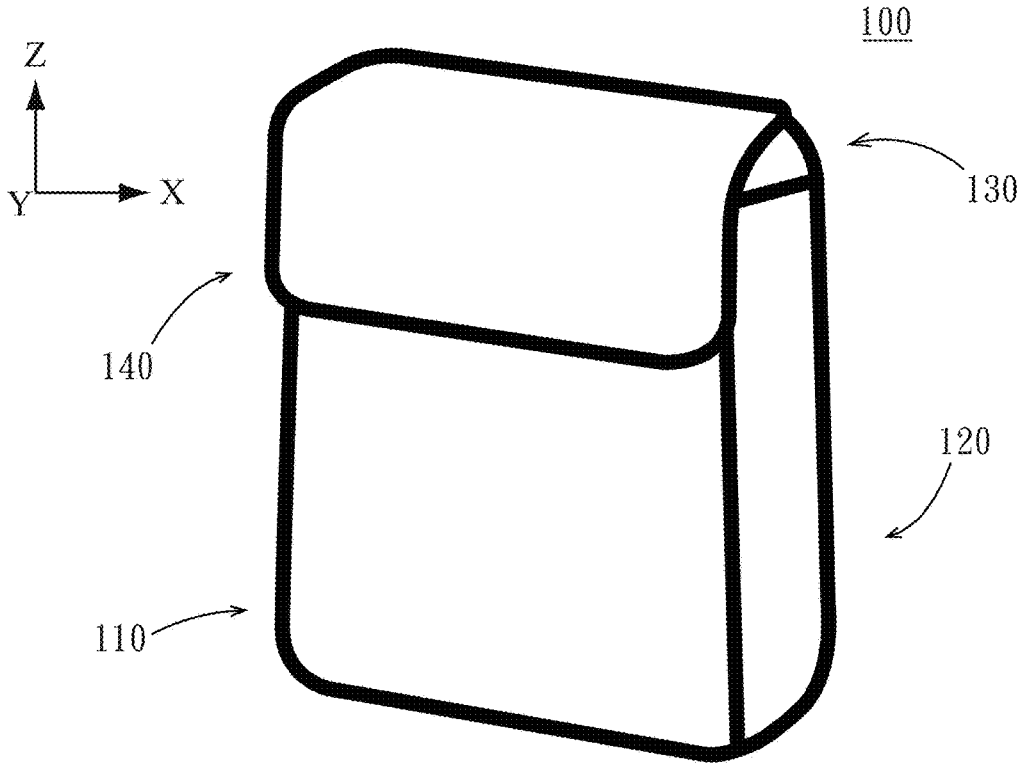
FIG. 7 is a schematic front view of the 2D stylish bag structure without a handle structure according to the present invention.
Figure 8:
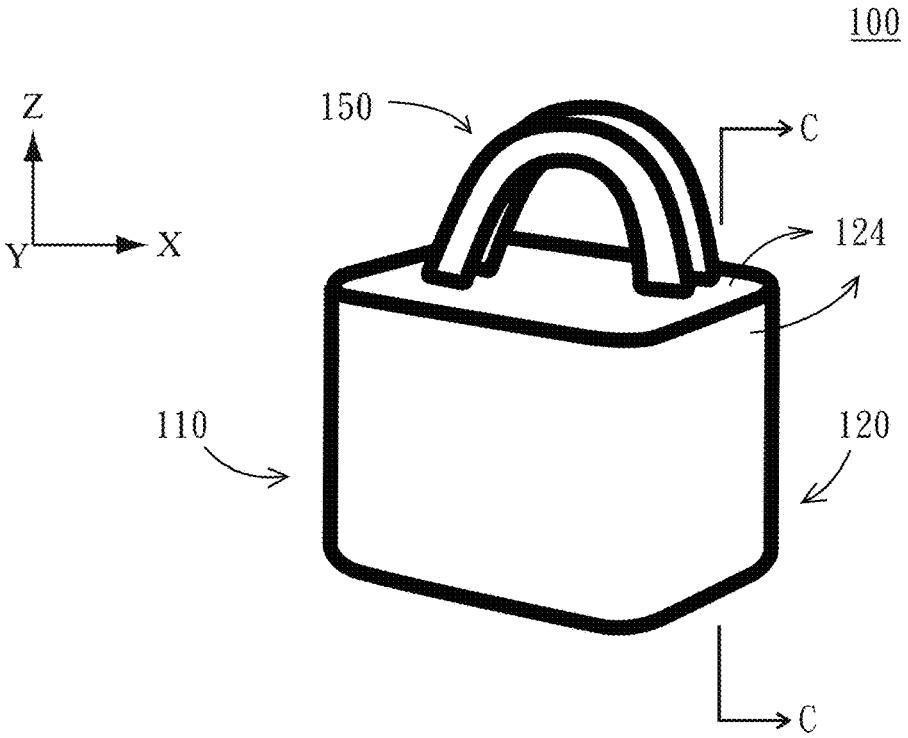
FIG. 8 is a schematic front view of the 2D stylish bag structure without a flip-cover structure according to the present invention.

It shall be appreciated that as will be readily devised by those of ordinary skill in the art, the flip-cover structure 140 may also be disposed on the virtual first view 114 of the first feature surface 110 and/or the virtual second view 124 of the second feature 120. Alternatively, as shown in FIG. 7, no handle structure is provided; or as shown in FIG. 8, no flip-cover structure is provided. As a result, the handle structure 150 is disposed on only the virtual second view 124 of the second feature surface 120 to obtain different configurations of the 2D stylish bag structure. Of course, the handle structure 150 may also be disposed on the back surface 130 of the 2D stylish bag structure 100 or optionally on the virtual first view 114 of the first feature surface 110 instead of being disposed on the virtual second view 124 of the second feature surface 120.

Furthermore, when there are two or more handle structures 150 in the 2D stylish bag structure 100 of the present invention, the positions of the handle structures 150 are opposite to and overlaps or slightly offsets each other to enhance the perspective 3D visual effect.

As shown in FIG. 1, in this embodiment, the handle structure 150 of the 2D stylish bag structure 100 of the present invention presents a flat form. The first border 112, second border 122 and third border 152 in the 2D stylish bag structure 100 are formed with a width between 1 mm and 20 mm, respectively, so that the virtual first view 114 and the virtual second view 124 are highlighted by means of the exaggerated borders to create a visual illusion for the consumer.

Figure 5:
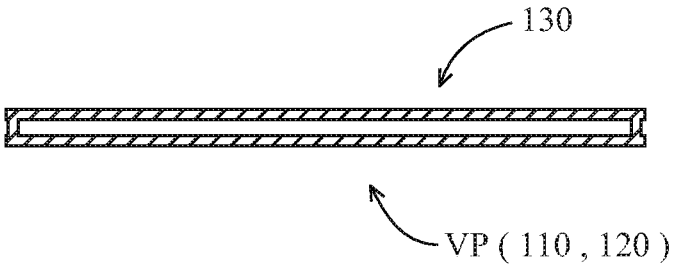
FIG. 5 is a cross-sectional view of the 2D stylish bag structure according to the present invention that is taken along line A-A in FIG. 1.

Therefore, as shown in FIG. 5, even though the first feature surface 110 and the second feature surface 120 are located in the same visual plane VP, the 3D bag structure can still be perceived by the consumer due to a perspective view formed by the exaggerated disposition of the first border 112, second border 122 and third border 152.

Figure 8A:
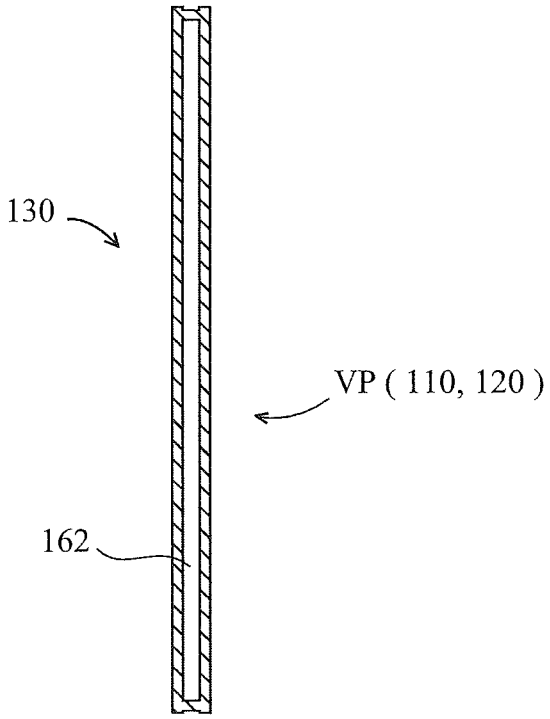
FIG. 8A is a cross-sectional view of the 2D stylish bag structure according to the present invention taken along line C-C in FIG. 8.
Figure 8B:
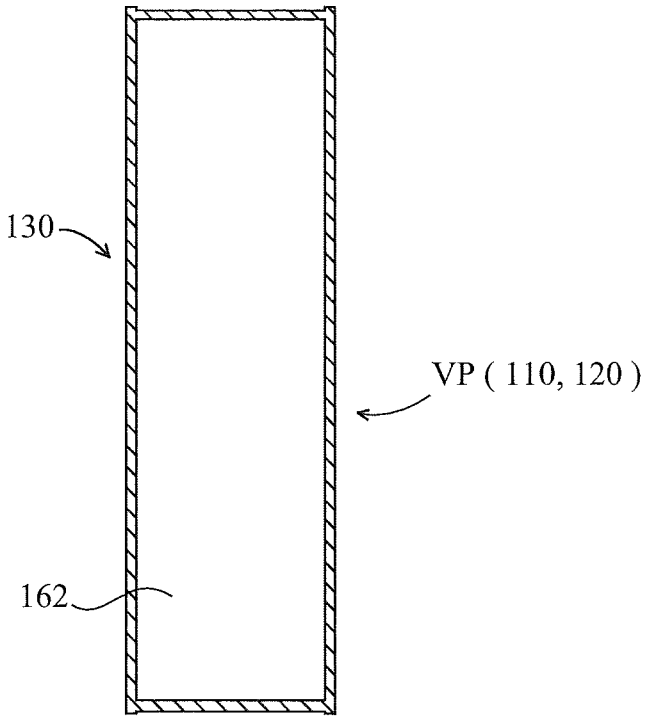
FIG. 8B is a cross-sectional view of the 2D stylish bag structure according to the present invention taken along line C-C in FIG. 8.

As shown in FIG. 6, the 2D stylish bag structure 100 of the present invention may further comprise at least one storage layer 160 capable of being freely adjusted that is disposed between the visual plane VP and the back surface 130 to form a receiving space 162. In the present invention, the section of the receiving space 162 is in a flat rectangular form as shown in FIG. 8A when no article is received therein. When an article is put therein, the receiving space can be extended to present a form of a wider rectangular as shown in FIG. 8B or a triangle as shown in FIG. 6, but the present invention is not limited thereto. That is, depending on different requirements, the cross-section of the receiving space 162 may also be in the form of a trapezoid or a sphere for receiving articles therein.

According to the above descriptions, through the disposition of such elements as the virtual first view, virtual second view, first border, second border and third border in the 2D stylish bag structure 100 of the present invention, a 3D visual effect of the bag can be obtained on a single visual plane to stimulate the consumers' interests in the bag.

Figure 12:
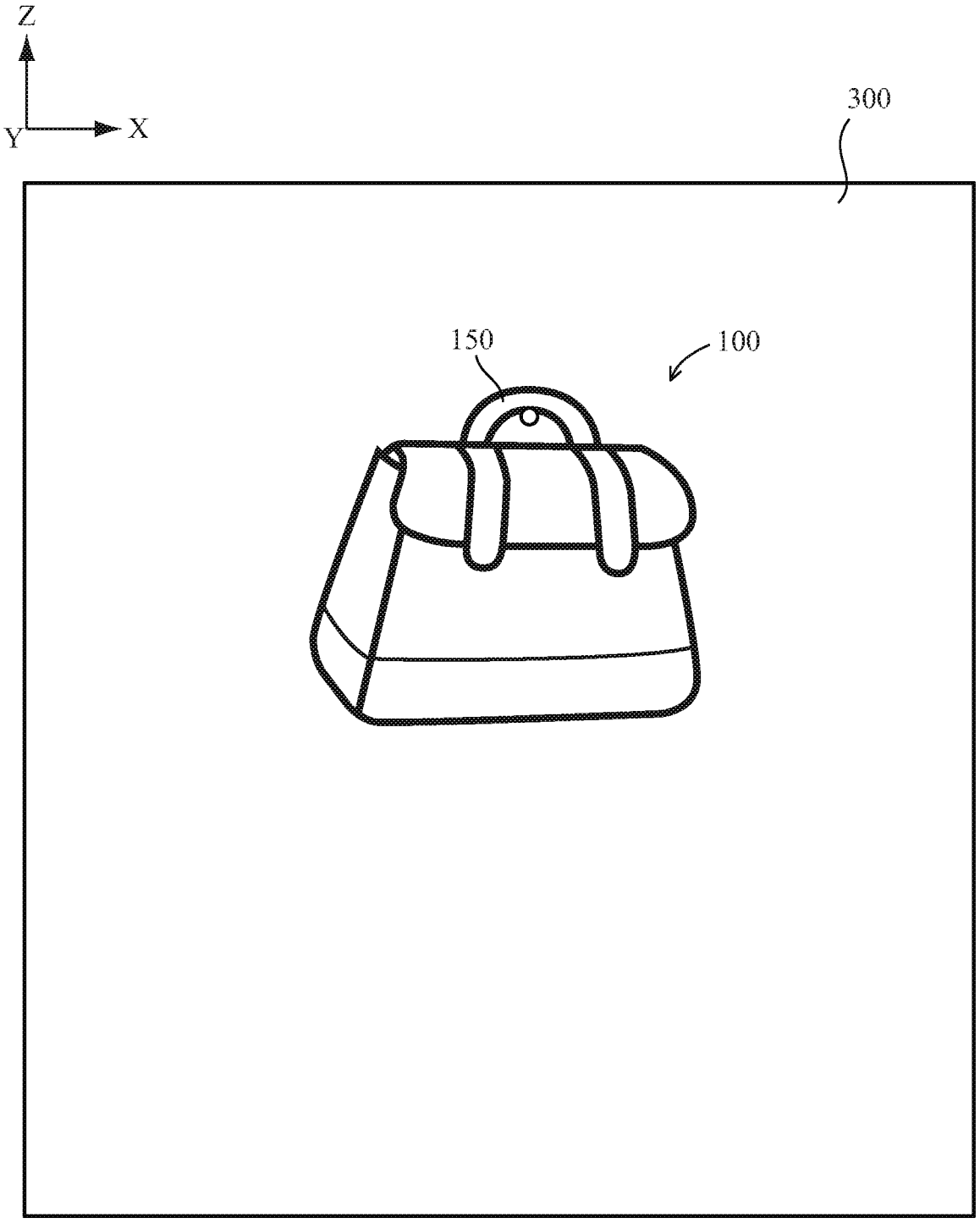
FIG. 12 is a schematic view of the 2D stylish bag structure according to the present invention when being hung from a wall.

Further, as shown in FIG. 12, when the handle structure 150 of the 2D stylish bag structure 100 of the present invention is hung on a wall 300, a perspective 3D visual effect of the bag can be presented on the wall 300 so that the bag can look like a picture or a decoration on the wall 300.

Hereinbelow, the second embodiment of the 2D stylish bag structure according to the present invention will be described.

Because the second embodiment is a variation of the first embodiment, the same or similar elements will be denoted by the same or similar reference numerals as those of the first embodiment and spatial relationships between the same or similar elements will not be further described herein.

Figure 9:
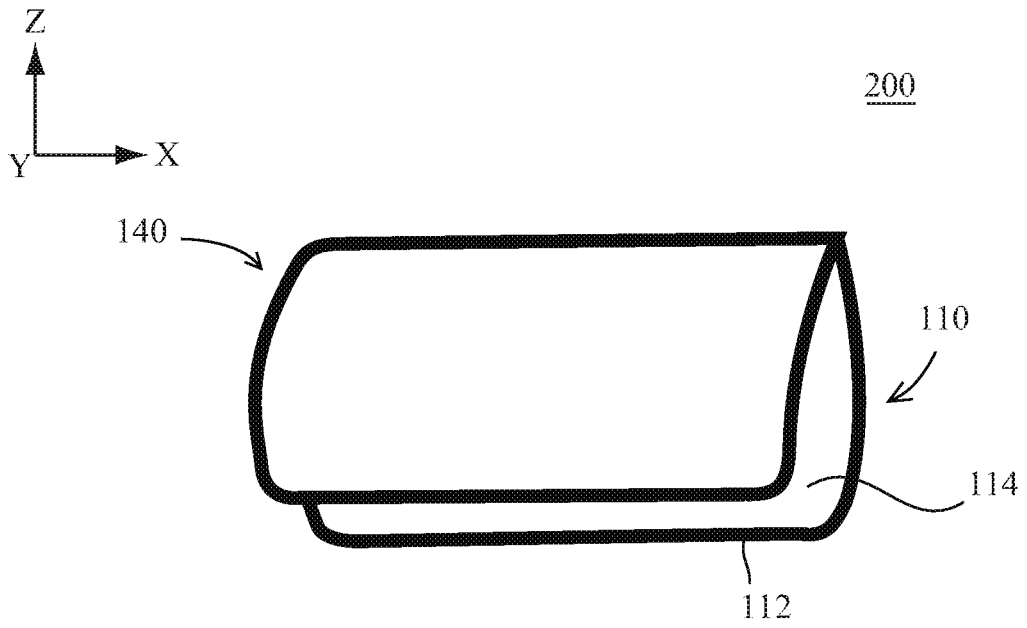
FIG. 9 is a schematic front view of the second embodiment according to the second embodiment of the present invention.

FIG. 9 is a schematic front view of the second embodiment of the 2D stylish bag structure according to the present invention. The 2D stylish bag structure 200 of the second embodiment differs from the 2D stylish bag structure 100 of the first embodiment of the first embodiment in that the 2D stylish bag structure 200 of the second embodiment has a first feature surface 110 and a flip-cover structure 140. By disposing the flip-cover 140 to partially or totally cover the virtual first visual plane 114 of the first feature surface 110 in the 2D stylish bag structure 200 of this embodiment, the perspective 3D visual illusion effect of viewing the bag can be enhanced.

Figure 10:
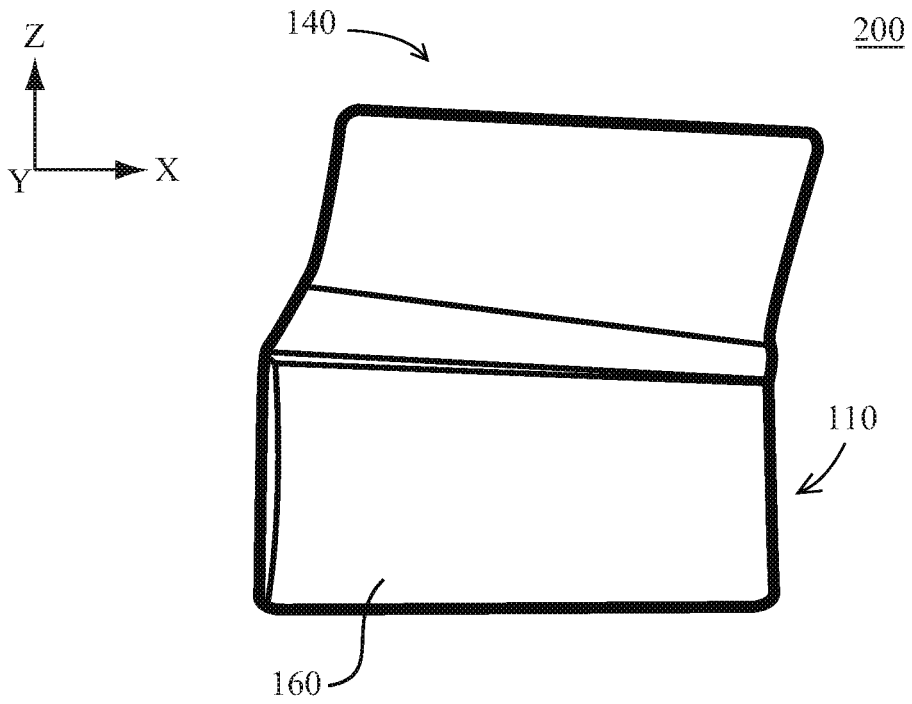
FIG. 10 is a schematic view of the 2D stylish bag structure according to the second embodiment of the present invention when the flip-cover structure is in an opened state.
Figure 11:
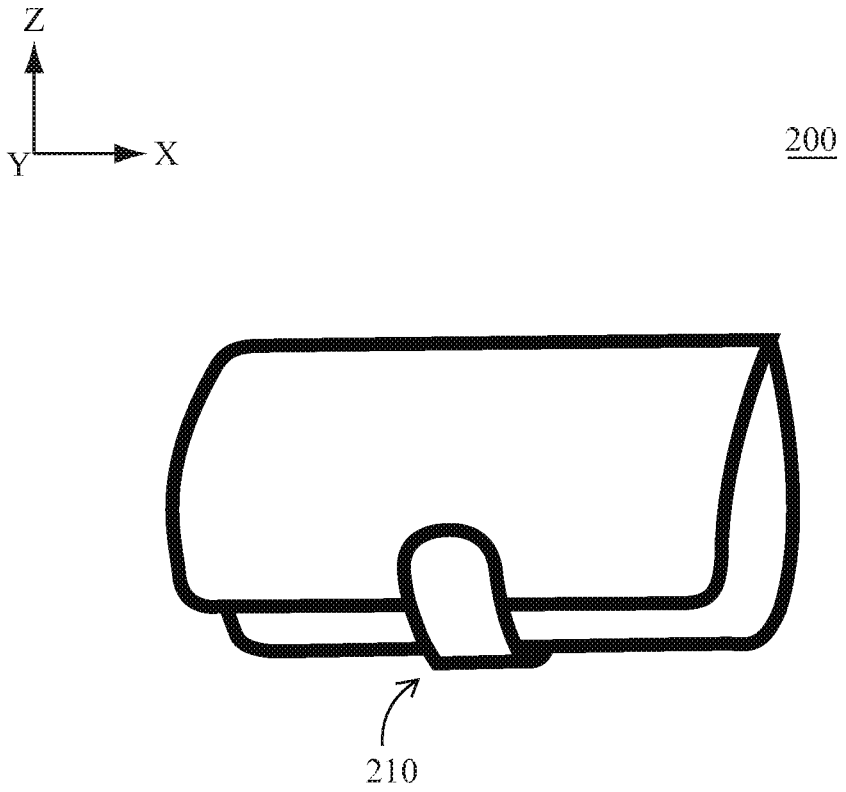
FIG. 11 is a schematic view of the 2D stylish bag structure according to the second embodiment of the present invention when the tongue flake structure thereof is in a fixed state.

As shown in FIG. 10, the 2D stylish bag structure 200 further comprises at least one storage layer 160 disposed at one side, which is covered by the flip-cover structure 140 of the first feature surface 110. The 2D stylish bag structure 200 in this embodiment may also be optionally provided with a tongue flake structure 210 which is sewed to the first feature surface 110 or the flip-cover structure 140 so that the flip-cover structure 140 and the first feature surface 110 can be fixed to each other to prevent dropout of articles.

It shall be appreciated that although not shown in the attached drawings, the 2D stylish bag structure of the present invention may also be provided with two or more flip-covers 140 and two or more storage layers 160 to provide the user with more storage space, and may also be provided with two or more tongue flake structures 210 to provide more secure fixation.

According to the above descriptions, through the disposition of such elements as the virtual first view, the flip-cover structure and the first border in the 2D stylish bag structure 200 of the present invention, a perspective 3D visual effect of the bag can be obtained on a single visual plane to stimulate the consumers' interests on the bag.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A bag structure, comprising:

a first feature surface, having a first borderline that defines a first view;

a second feature surface, having a second borderline that defines a second view; and a back surface, being disposed opposite the first feature surface and the second feature surface, wherein the combination of the first feature surface, the second feature surface, and the back surface is structured to define the bag structure, and the first feature surface and the second feature surface are substantively on a same plane.

2. The bag structure as claimed in claim 1, wherein the first view is a front view, and the second view is a side view, a top view, a bottom view or includes any two of the side, top and bottom views, thereby a person tends to confuse the second view with a real corresponding view or views of the bag structure.

3. The bag structure as claimed in claim 1, further comprising at least one flip-cover structure that is disposed on and covers the first feature surface and/or the second feature surface.

4. The bag structure as claimed in claim 3, wherein the amount of the at least one handle structure is two or more, and the position of the at least one handle structure are opposite to and overlaps each other or slightly offset to each other.

5. The bag structure as claimed in claim 4, wherein the first borderline, the second borderline and the third borderline have a width between 1 mm to 20 mm.

6. The bag structure as claimed in claim 1, further comprising at least one handle structure that is sewed to connect with the first feature surface and/or the second feature surface and has a third borderline.

7. The bag structure as claimed in claim 6, wherein the at least one handle structure is a flat form.

8. The bag structure as claimed in claim 1, further comprising at least one storage layer that is disposed between a layer composed by the first feature surface and the second feature surface, and the back surface.

9. The bag structure as claimed in claim 8, wherein the at least one storage layer has a receiving space and the section of the receiving space presents a triangle, a rectangle, a trapezoid or a round.

* * * * *